US007165942B2

(12) United States Patent
Junker et al.

(10) Patent No.: US 7,165,942 B2
(45) Date of Patent: Jan. 23, 2007

(54) FAN IMPELLER WITH INTEGRATED GREASE SEPARATION, ESPECIALLY FOR COOKING APPLIANCE

(75) Inventors: Elmar Junker, Germering (DE); Thomas Schreiner, Hurlach (DE); Bruno Maas, Kaufering (DE); Peter Kohlstrung, Kaufering (DE); Manfred Breunig, Schongau (DE)

(73) Assignee: Rational AG, Landsberg/Lech (DE)

( * ) Notice: Subject to any disclaimer, the term of this patent is extended or adjusted under 35 U.S.C. 154(b) by 0 days.

(21) Appl. No.: 10/525,192

(22) PCT Filed: Aug. 6, 2003

(86) PCT No.: PCT/DE03/02640

§ 371 (c)(1),
(2), (4) Date: Sep. 6, 2005

(87) PCT Pub. No.: WO2004/020837

PCT Pub. Date: Mar. 11, 2004

(65) Prior Publication Data

US 2006/0165528 A1 Jul. 27, 2006

(30) Foreign Application Priority Data

Aug. 22, 2002 (DE) ..... 102 39 246

(51) Int. Cl.
*F04D 29/28* (2006.01)
*B01D 45/14* (2006.01)

(52) U.S. Cl. ..... 416/178; 55/428; 55/437; 55/466; 416/187; 416/236 R; 416/223 B

(58) Field of Classification Search ..... 416/235, 416/236 R, 223 B, 178, 179, 182, 183, 185, 416/186 R, 187, 237
See application file for complete search history.

(56) References Cited

U.S. PATENT DOCUMENTS 262,642 A * 8/1882 Collins ..... 415/228

(Continued)

FOREIGN PATENT DOCUMENTS

DE 729 947 1/1943

(Continued)

OTHER PUBLICATIONS

Examination Report in GB 102 39 246 dated Nov. 21, 2003.

(Continued)

*Primary Examiner*—Richard A. Edgar
(74) *Attorney, Agent, or Firm*—Marshall, Gerstein & Borun LLP

(57) ABSTRACT

The disclosure relates to a fan impeller including a base plate and a plurality of fan impeller blades fixed to the plate. The fan impeller blades are positioned in an essentially vertical manner on the base plate and have a substantially radial arrangement, each fan impeller blade including a front edge facing radially outwardly that is substantially perpendicular to the base plate, a rear edge facing radially inwardly that is substantially perpendicular to the base plate, an exterior surface located on the delivery side of the fan impeller and an interior surface located on the intake side of the fan impeller. At least one raised element is mounted and/or configured on the exterior surface of at least one selection of the fan impeller blades, the element being positioned at a distance from the base plate and extending substantially in a diagonal manner away from the base plate from the front edge to the rear edge of the fan impeller blades. The disclosure also relates to a fan impeller in a cooking device and to a cooking device including at least one inventive fan impeller.

33 Claims, 1 Drawing Sheet

U.S. PATENT DOCUMENTS

| | | | | |
|---|---|---|---|---|
| 1,688,345 | A | 10/1928 | Mursch et al. | |
| 2,616,764 | A | 11/1952 | Parrish | 302/37 |

FOREIGN PATENT DOCUMENTS

| | | | |
|---|---|---|---|
| DE | 42 06 846 | A1 | 9/1993 |
| DE | 42 20 960 | A1 | 1/1994 |
| DE | 43 07 405 | C1 | 11/1994 |
| DE | 102 39 246 | C1 | 8/2003 |
| EP | 224 398 | | 6/1987 |
| EP | 270 393 | | 6/1988 |
| EP | 615 069 | B1 | 9/1994 |

OTHER PUBLICATIONS

International Search Report in PCT/DE03/02640 dated Dec. 18, 2003.

* cited by examiner

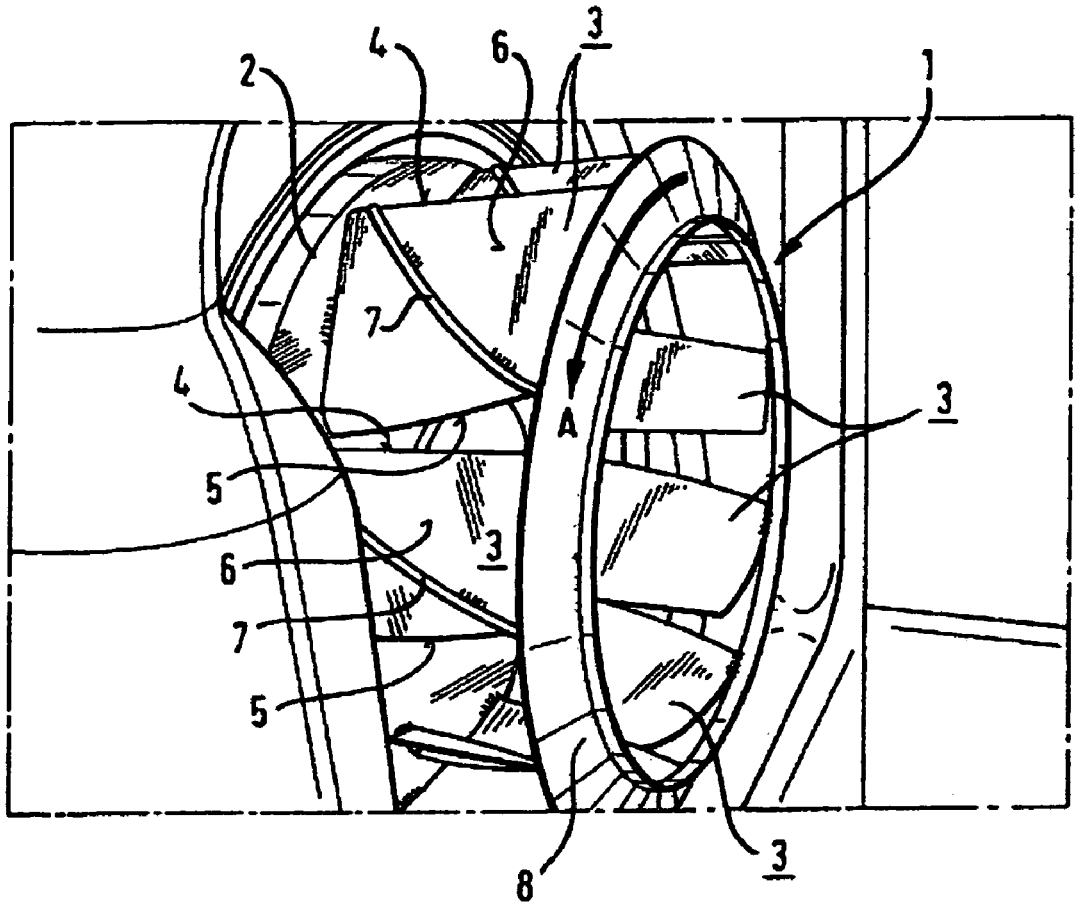
2
4
6
3
1
7
4
A
3
5
6
3
7
5
8
3

FAN IMPELLER WITH INTEGRATED GREASE SEPARATION, ESPECIALLY FOR COOKING APPLIANCE

This is the U.S. national phase of International Application No. PCT/DE03/02640 filed Aug. 6, 2003, the entire disclosure of which is incorporated herein by reference.

BACKGROUND OF THE INVENTION

1. Field of the Disclosure

The disclosure concerns a fan impeller with a base plate and a number of fan impeller blades fastened to the base plate, the fan impeller blades being substantially arranged perpendicularly to the base plate and forming a substantially radial arrangement in which each fan impeller blade has a front edge arranged radially outwardly and substantially perpendicular to the base plate, a rear edge arranged radially inwardly and substantially perpendicular to the base plate, an outer surface arranged on the delivery side of the fan impeller and an outer surface arranged on the intake side of the fan impeller.

2. Related Technology

Fan impellers are generally known from the prior art and are used to circulate air. Fan impellers are known in a wide variety of forms, for example, fan impellers with propeller-like blades or with blade-like vanes are known. One problem in fan impellers known from the prior art is that solid and/or liquid particles present in the circulated air can deposit on the vanes of the fan impeller, which leads to soiling of the fan impeller. Undesired distribution of solid and/or liquid particles can also occur from the known fan impellers.

A particular problem is circulation of solid and/or liquid particles, especially in the form of grease particles, when the fan impeller is arranged within a cooking appliance. The fan impeller is generally arranged in a cooking appliance in a fan compartment separated from the cooking space by an air baffle, draws in air from the cooking space and diverts it radially to the enclosing walls in order to create air flow within the cooking appliance from the cooking space into the fan compartment and back again to the cooking space. A heating device or also a heat exchanger is often arranged around the fan impeller so that circulated air is also guided past this heating device or this heat exchanger in order to be heated. During a cooking process grease particles present in the circulated air can then also be guided to the heating device, where they can be burned, which can lead to a reduction in food quality and an odor burden. This is a particular problem if the air is permanently circulated within the cooking appliance by the fan impeller, in which case the solid and/or liquid particles are continuously kept in the gas volume by the circulating flow.

In order to reduce depositing of solid and/or liquid particles circulated by the fan impeller within a cooking appliance, is a device is known from DE 42 06 846 C2 that includes an impact surface or a separation ring around the fan impeller on which a gas flow prevailing in the gas volume occurs, in which case the solid and/or liquid particles are at least partially separated on impact and can go to a first bypass area.

A fan impeller with a number of radially arranged blades that protrude essentially parallel to the axis of rotation of the fan impeller from a support plate or base plate facing the housing wall of the cooking appliance is also known from DE 43 074 05 C2 in which baffles are arranged at least between some of the blades near the support disk, but with a spacing from it, whose radial outside edges are essentially flush with the outside periphery of the fan impeller, the radial inner edges lie at a spacing from the axis of rotation of the fan impeller and form a nozzle device with the support disk and the two adjacent blades to create a gas stream near the support plate directed radially outward.

A fan impeller is known from U.S. Pat. No. 1,688,345 in which at least one elevation extending away from the base plate is arranged on the outer surface of at least one part of the fan blades.

However, a shortcoming in the devices known from the prior art is that the efficiency of the fan impeller is reduced by the additional devices surrounding the fan impeller or arranged in the fan impeller, since the additional devices represent an obstacle to flow for the circulated air.

GENERAL DESCRIPTION

The disclosure therefore provides a fan impeller construction so that the drawbacks of the prior art are overcome. In particular, it is to be prevented that solid and/or liquid particles present in air circulated in a cooking appliance directly reach a heating device or heat exchanger surrounding the fan impeller because of the fan impeller without significantly reducing the efficiency of the fan impeller.

The disclosure provides an impeller wherein at least one elevation is arranged and/or formed on the outer surface of at least one part of the fan impeller blades, which is spaced from the base plate and extends away from the base plate essentially diagonally from the front edge to the rear edge of the fan impeller blades.

It is then prescribed in particular that the elevation be designed in the form of a step on and/or in the outer surface.

The disclosure also proposes that the fan impeller blades be curved so that the outer surface curves radially outward between the front edge and the rear edge.

It is advantageous that at least one elevation has a height of about 1 to 10 mm, preferably 2 to 4 mm, at least in areas.

It can also be prescribed according to the invention that at least one elevation has a width from 1 to 10 mm, preferably 2 to 4 mm, at least in areas.

The fan impeller according to the invention is preferably characterized by the fact that the spacing of at least one elevation to the base plate, at least in areas, especially in the region of the front edge, is at least 5 to 25 mm, preferably 10 to 20 mm.

A support element, as in the form of a cover ring, of the fan impeller blades on the side of the fan impeller blades opposite the base plate is also proposed with the invention.

It is preferred that at least one elevation be designed arc-like at least in areas, in which it is preferably bent away from the support element.

It is also proposed that at least one elevation forms an angle of 45° to 90° with the front edge, preferably an angle of 70° to 90°.

It is preferred that at least one elevation has at least in areas a spacing to the support element, especially in the region of the rear edge, of at least about 1 to 10 mm, preferably 5 to 15 mm.

It is also preferred that at least one elevation be formed by at least one wire.

It is also proposed with the invention that at least one elevation be welded, at least in areas onto the outer surface of the fan impeller blade.

It can be proposed in particular according to the invention that on the outside surface of at least one fan impeller blade, preferably each fan impeller blade, a distinct edge as in the form of a groove, be formed in the fastening region between the corresponding elevation and the outer surface, at least in areas, on the side lying in the direction of rotation of the fan impeller.

It is advantageously prescribed that at least one elevation have a profiled cross-section at least in areas, be preferably bulged, in which the focal point of the bulge lies on the side of the elevation facing the rear edge, and/or has at least one groove, preferably on the side facing the rear edge.

It is also preferred that at least one elevation be tightly joined, preferably with silicon to the outer surface, at least in areas, on the side facing away from the direction of rotation of the fan impeller.

The disclosed fan impeller can be arranged in a cooking appliance.

The basis of the disclosed fan impeller is the surprising finding that by elevations on the outer surface of the fan impeller blades on a base plate, a situation in which solid and/or liquid particles contained in the circulated air, especially in the form of grease particles, are diverted radially by the fan impeller is avoided. Instead, solid and/or liquid particles that strike the outer surfaces of the fan impeller blades are stopped on the elevation and diverted in the direction toward the base plate by the special geometry of the elevation. In the region of the base plate the solid and/or liquid particles can then be released from the fan impeller blades without striking devices that are arranged radially around the fan impeller, for example, a heating device within a cooking appliance.

Since the solid and/or liquid particles are not released by the fan impeller blades directly to the devices radially surrounding the fan impeller, like a heating device, a situation is prevented in which grease particles in particular can be burned on the heating device, which could lead to a reduction in food quality and an odor burden.

On the other hand, because of the disclosed fan impeller a situation is surprisingly achieved in which the efficiency of the fan impeller is not significantly compromised, since no large obstacles are arranged in the radial flow path of the circulated air. In addition, the elevations arranged on the outsides of the fan impeller blades ensure additional stability of the fan impeller blades themselves.

BRIEF DESCRIPTION OF THE DRAWING

Additional features and advantages of the invention are apparent from the following description, in which a practical example of the disclosed fan impeller is described in detail by means of a drawing consisting of a single figure. The figure shows a perspective view of a fan impeller according to the disclosure.

DETAILED DESCRIPTION OF THE DRAWING

The figure shows a perspective view of a fan impeller 1 that can be incorporated in a fan compartment of a partially depicted cooking appliance in order to circulate air rotating in the direction of arrow A in a cooking space that is separated in areas from the fan compartment by an air baffle (not shown). The fan impeller 1 has abase plate 2, on which a number of fan impeller blades 3 are arranged, which face the cooking space of the cooking appliance. The fan impeller blades 3 are curved and arranged essentially perpendicular to the base plate 2 in order to form an essentially radial arrangement on the base plate 2. Each fan impeller blade 3 during operation has a rear edge 5 that comes in contact first with the circulating air and an outer surface 6 arranged on the delivery side of the fan impeller 1 during operation. An elevation 7 is also provided on the outer surface 6 of a fan impeller blade 3, which extends away from the base plate 2 essentially diagonally from one front edge 4 to the rear edge 5 of the fan impeller blade 3. The elevation 7 is then arranged with a spacing from 10 to 20 mm from the base plate 2 on the outer surface 6. The elevation 7 can extend completely over the entire width of fan impeller blade 3 or have a spacing to the side of the fan impeller blade 3 opposite the base plate 2, in which the spacing is preferably 5 to 15 mm. On the side of fan impeller blade 1 opposite the base plate 2 a cover ring 8 is provided, which ensures additional stabilization of the fan impeller blades 3 within the fan impeller 1. The elevation 7 should rise from the outer surface 6 of the fan impeller blade 3 by 2 to 5 mm and end with a sharp edge on the rear edge 5 of the fan impeller blade 3 on the end facing the air flow in order to form a discharge groove for solid and/or liquid particles, which prevents further flow of the solid and/or liquid particles beyond the elevation 7 and guides them in the direction of the base plate 2. In addition, sealing can be provided on the side lying in the flow shadow between the outer surface 6 and the elevation 7.

This sealing can occur, for example, with silicone, but any other sealing can be provided that is obvious to one skilled in the art in this field.

The method of operation of the impeller blade 1 is described below.

The impeller blade 1 is rotated in the fan compartment in the direction of arrow A via a motor not shown in the figure, and therefore draws in air from the cooking space through a center opening in the air baffle and guides it radially outwardly so that it goes back to the cooking space from the fan compartment via the air baffles. Solid and/or liquid particles, especially grease particles of different size, that reach the region of the fan impeller 1, strike the outer surfaces 6 of the fan impeller blades 3 on the delivery side of the fan impeller and are diverted along the elevation 7 in the direction toward the base plate 2. If the solid and/or liquid particles reach the end region of the elevation 7 on the front edge 4 of the fan impeller blades 3 (and finally the base plate 2), the solid and/or liquid particles released at that point cannot be released directly to the device radially surrounding the fan impeller 1, for example, in the form of a heating device (not shown) or a heat exchanger (not shown). Because of this "leading" of the solid and/or liquid particles past a heating device and/or a heat exchanger, their burning is prevented, which can lead to an odor burden and a negative effect on the cooking result. Instead, the separated solid and/or liquid particles can be disposed of.

The fan impeller according to the invention of the disclosure in a cooking appliance therefore prevents solid and/or liquid particles from being deposited directly on a heating device enclosing the fan impeller and also ensures that air circulated by the fan impeller 1 can be diverted completely radially, since the efficiency of the fan impeller 1 is only slightly reduced by the elevation 7. The fan impeller 1 acquires higher stability because of the elevations 7.

LIST OF REFERENCE NUMBERS

1 Fan impeller
2 Base plate
3 Fan impeller blade
4 Front edge
5 Rear edge
6 Outer surface

7 Elevation
8 Cover ring
A Direction of rotation

The invention claimed is:

1. Fan impeller having an intake side and a delivery side and comprising a base plate and a plurality of fan impeller blades fastened to the base plate, the fan impeller blades being disposed substantially perpendicularly to the base plate and forming a substantially radial arrangement, in which each fan impeller blade has a front edge disposed radially outwardly and substantially perpendicular to the base plate, a rear edge disposed radially inwardly and substantially perpendicular to the base plate, an outer surface disposed on the delivery side of the fan impeller and an inner surface disposed on the intake side of the fan impeller wherein at least one elevation is at least one of disposed or formed on the outer surface of at least one part of the fan impeller blades and is spaced from the base plate and extending away from the base plate substantially diagonally from the front edge to the rear edge of the fan impeller blades.

2. Fan impeller according to claim 1, wherein the elevation comprises a step on and/or in the outer surface.

3. Fan impeller according to claim 1, wherein the fan impeller blades are curved so that the outer surface curves radially outwardly between the front edge and rear edge.

4. Fan impeller according to claim 1, wherein at least one elevation has a height of about 1 mm to 10 mm, at least in a portion of the elevation.

5. Fan impeller according to claim 4, wherein at least one elevation has a height of 2 mm to 4 mm, at least in a portion of the elevation.

6. Fan impeller according to claim 1, wherein at least one elevation has a width of 1 mm to 10 mm, at least in a portion of the elevation.

7. Fan impeller according to claim 6, wherein at least one elevation has a width of 2 mm to 4 mm, at least in a portion of the elevation.

8. Fan impeller according to claim 1, wherein a spacing of at least one elevation to its associated base plate is about 5 mm to 25 mm, at least in a portion of the elevation.

9. Fan impeller according to claim 8, wherein said spacing is in the area of the front edge.

10. Fan impeller according to claim 8, wherein said spacing is 10 mm to 20 mm, at least in a portion of the elevation.

11. Fan impeller according to claim 1, comprising a support element, of the fan impeller blades, on a side of the fan impeller blades opposite the base plate.

12. Fan impeller according to claim 11, wherein the support element forms a cover ring.

13. Fan impeller according to claim 7, comprising at least one elevation that is at least partially arc-shaped.

14. Fan impeller according to claim 13, wherein said elevation is bent from the corresponding rear edge to the corresponding front edge away from the support element.

15. Fan impeller according to claim 11, wherein at least one elevation has at least in areas a spacing to a support element of at least about 1 mm to 10 mm.

16. Fan impeller according to claim 15, wherein said spacing is in the region of the rear edge.

17. Fan impeller according to claim 15, wherein said spacing is 5 mm to 15 mm.

18. Fan impeller according to claim 1, wherein at least one elevation forms an angle of 45° to 90° with the front edge.

19. Fan impeller according to claim 18, wherein said angle is 70° to 90°.

20. Fan impeller according to claim 1, wherein at least one elevation is formed by at least one wire.

21. Fan impeller according to claim 1, wherein at least one elevation is welded onto the outer surface of the fan impeller blade, at least in a portion of the elevation.

22. Fan impeller according to claim 1, further comprising a distinct edge formed on the outer surface of at least one fan impeller blade.

23. Fan impeller according to claim 22, wherein said distinct edge is found in the fastening region between the corresponding elevation and the outer surface at least in areas on the side lying in the direction of rotation of the fan impeller.

24. Fan impeller according to claim 22, wherein said distinct edge is formed or disposed on each fan impeller blade.

25. Fan impeller according to claim 22, wherein said distinct edge has the form of a groove.

26. Fan impeller according to claim 1, wherein at least one elevation has a profiled cross-section at least in a portion of the elevation.

27. Fan impeller according to claim 26, wherein said elevation having a profiled cross-section is bulged, at least in a portion of the elevation.

28. Fan impeller according to claim 27, wherein said elevation has at least one groove.

29. Fan impeller according to claim 28, wherein said groove is on the side facing the rear edge.

30. Fan impeller according to claim 27, wherein a focal point of the bulge lies on the side of the elevation facing the rear edge.

31. Fan impeller according to claim 1, wherein that at least one elevation is tightly joined, to the outer surface, at least in areas, on the side facing away from the direction of rotation of fan impeller.

32. Fan impeller according to claim 31, wherein said elevation is tightly joined to the outer surface with silicone.

33. A cooking appliance comprising a fan impeller according to claim 1.

* * * * *